United States Patent [19]

Kobayashi et al.

[11] 4,354,474

[45] Oct. 19, 1982

[54] FUEL INJECTION ADVANCE ANGLE CONTROL APPARATUS

[75] Inventors: Masayoshi Kobayashi; Toru Sakuranaka; Keiichi Yamada; Masayasu Hayakawa; Sachio Nakagawa; Kohki Iwata; Ryuichi Komori, all of Matsuyama, Japan

[73] Assignee: Diesel Kiki Company, Ltd., Tokyo, Japan

[21] Appl. No.: 60,094

[22] Filed: Jul. 24, 1979

[30] Foreign Application Priority Data

Sep. 28, 1978 [JP] Japan ..... 53-118978

[51] Int. Cl.[3] ..... F02M 59/32

[52] U.S. Cl. ..... 123/502; 123/501; 123/179 L; 417/462

[58] Field of Search ..... 123/139 ST, 179 L, 140 FG, 123/139 AQ, 139 AP, 501, 502; 417/462

[56] References Cited

U.S. PATENT DOCUMENTS

| | | | |
|---|---|---|---|
| 2,910,975 | 11/1959 | Evans | 417/462 |
| 3,147,746 | 9/1964 | Höfer | 417/462 |
| 3,815,564 | 6/1974 | Suda | 123/501 |
| 3,943,902 | 3/1976 | Skinner | 123/450 |
| 4,050,453 | 9/1977 | Tokashiki | 123/139 AQ |
| 4,122,813 | 10/1978 | Barnert | 123/502 |

FOREIGN PATENT DOCUMENTS

| | | | |
|---|---|---|---|
| 2620520 | 12/1977 | Fed. Rep. of Germany | 123/501 |

*Primary Examiner*—Charles J. Myhre
*Assistant Examiner*—Carl Stuart Miller
*Attorney, Agent, or Firm*—David G. Alexander

[57] ABSTRACT

In a distribution type fuel injection system, the fuel injection advance angle, or the relative angular position at which fuel injection begins, is controlled by a first spring loaded piston (44). The spring force is opposed by pressurized fuel from a pump (14), the pressure increasing with engine speed. A second spring loaded piston (49) moves the first piston (44) to an advanced position for starting the engine and is retracted when the fuel pressure reaches a certain value to subsequently retard the advance angle in an idling speed range. The fuel pressure moves the first piston (44) to progressively advance the angle in a higher speed range. An electromagnetic valve (62) is controlled to trap fuel and apply a hydraulic lock to the second piston (49) during starting of the engine to prevent retarding of the advance angle until the engine speed or coolant temperature reaches a predetermined value.

7 Claims, 4 Drawing Figures

FUEL INJECTION ADVANCE ANGLE CONTROL APPARATUS

BACKGROUND OF THE INVENTION

The present invention relates to a fuel injection advance angle control apparatus for an internal combustion engine such as a Diesel engine.

Fuel injection systems are popular in the field of internal combustion engines due to their many advantages, especially where adapted to combustion ignition or Diesel engines. Typical of such systems is the distribution system in which a plunger is simultaneously rotated and reciprocated to pump fuel to injection nozzles of a number of engine cylinders.

The performance and efficiency of the engine depend on fuel injection at the right time and in the right amount. The problem is complicated by the fact that the proper time for fuel injection is a function not only of engine speed but also engine operating conditions such as starting, idling, high speed running and the like.

Generally, it is necessary to progressively increase the fuel injection advance angle as the engine speed increases. What is meant by the advance angle is the relative angular position in the engine operating cycle at which fuel injection is initiated and may be considered as the number of degrees before the engine piston reaches top dead center at which fuel injection begins. In addition to the basic relationship between advance angle and engine speed, it is also necessary to advance the angle upon starting the engine and retard the angle for idling.

A known system for achieving this operation comprises an engine driven pump which pumps fuel from a reservoir or tank at a pressure which increases with engine speed. The pressurized fuel is applied to a spring loaded piston which is connected to an advance angle control mechanism. The fuel pressure balanced against the spring force positions the piston which in turn sets the advance angle at a value which corresponds to the position of the piston. In this manner, the advance angle is increased as the engine speed increases.

The advance angle is increased upon starting by another spring loaded piston which moves the main piston to an advanced position at low engine speed. As the engine speed and fuel pressure increase, the secondary piston is retracted and the main piston allowed to move to a retarded position for constant speed idling. Further increase in the engine speed and fuel pressure cause the main piston to be moved from the retarded position in the normal manner to increase the advance angle.

A problem in this basic system is that the fuel pressure increases quickly upon starting and the advance angle is changed from the advanced to the retarded value before stable combustion is attained in the engine. This results in extreme difficulty in starting the engine since the advance angle is retarded prematurely while the engine temperature is still low.

SUMMARY OF THE INVENTION

A fuel injection control apparatus for an engine embodying the present invention includes a housing having a first bore, a second bore having an end wall, the first bore colinearly communicating with the second bore through said end wall, a diameter of the second bore being larger than a diameter of the first bore, a first piston slidable in the first bore and being connected so that a fuel injection advance angle of the apparatus corresponds to a position of the first piston, a second piston slidable in the second bore, a first spring urging the first piston toward abutment with the second piston, a second spring urging the second piston toward abutment with said end wall, a non-pressurized liquid fuel reservoir, engine driven pump means for pumping fuel from the reservoir at a pressure which increases with engine speed and a first passageway connecting the pump means with a space between adjacent ends of the first and second pistons respectively. A second passageway connects the reservoir with the second bore such that fuel from the reservoir is constantly urged to flow through the second passageway into the second bore and contact an end of the second piston opposite said adjacent end. A valve is disposed in the second passageway, and control means initially close the valve and open the valve after an engine operating parameter reaches a predetermined value.

In accordance with the present invention, in a distribution type fuel injection system, the fuel injection advance angle, or the relative angular position at which fuel injection begins, is controlled by a first spring loaded piston. The spring force is opposed by pressurized fuel from a pump, the pressure increasing with engine speed. A second spring loaded piston moves the first piston to an advanced position for starting the engine and is retracted when the fuel pressure reaches a certain value to subsequently retard the advance angle in an idling speed range. The fuel pressure moves the first piston to progressively advance the angle in a higher speed range. An electromagnetic valve is controlled to trap fuel and apply a liquid lock to the second piston during starting of the engine to prevent retarding of the advance angle until the engine speed or coolant temperature reaches a predetermined value.

It is an object of the present invention to provide a fuel injection advance angle control apparatus for a distribution type fuel injection system for an internal combustion engine which overcomes the drawbacks of the prior art and operates in a stable and efficient manner.

It is another object of the present invention to provide a fuel injection advance control apparatus which provides easy and stable starting, idling and high speed operation of an internal combustion engine.

It is another object of the present invention to provide a fuel injection advance control apparatus which may be advantageously and economically manufactured, installed and maintained on a commercial production basis.

It is another object of the present invention to provide a generally improved fuel injection advance control apparatus for an internal combustion engine.

Other objects, together with the foregoing, are attained in the embodiments described in the following description and illustrated in the accompanying drawing.

DESCRIPTION OF THE PREFERRED EMBODIMENTS

While the fuel injection advance angle control apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
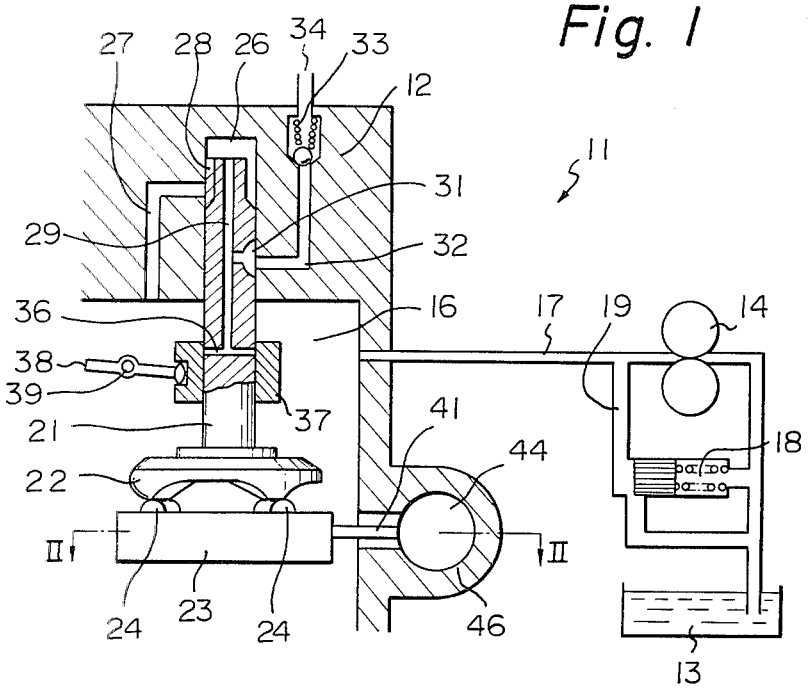
FIG. 1 is a schematic drawing of a fuel injection advance control apparatus embodying the present invention.
Figure 3:
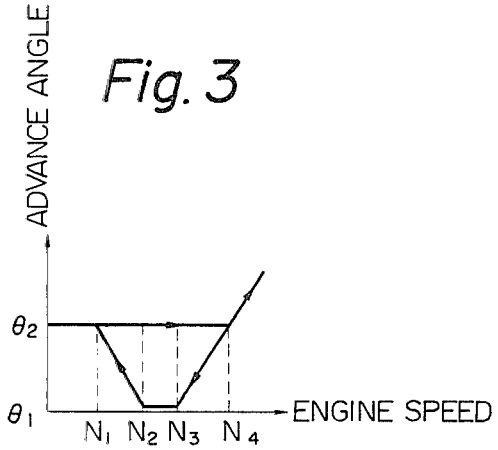
FIG. 3 is a graph illustrating the operation of the present invention.
Figure 2:
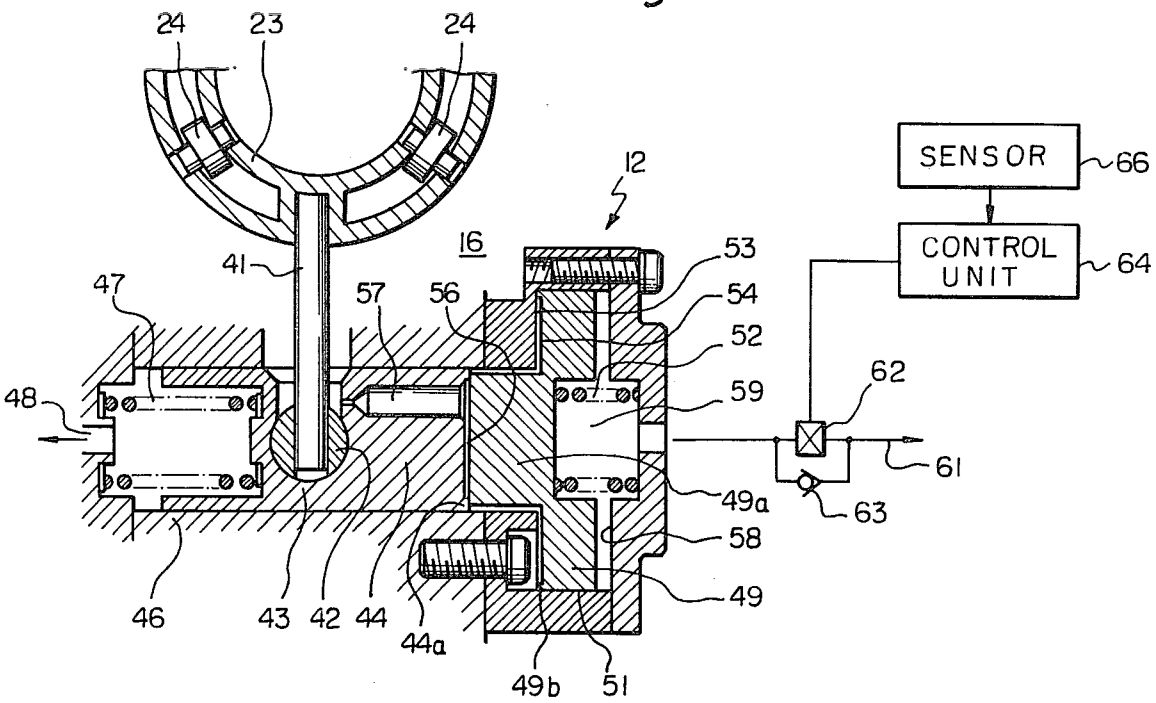
FIG. 2 is a section taken on a line II—II of FIG. 1.

Referring now to FIGS. 1 to 3 of the drawing, a fuel injection advance angle control apparatus embodying the present invention is generally designated by the reference numeral 11 and comprises a housing 12. Liquid fuel such as diesel oil is provided in a reservoir or tank 13. A pump 14 feeds fuel from the tank 13 to a chamber 16 in the housing 12 through a line 17. A pressure relief valve 18 is provided in a bypass line 19 to prevent the pressure in the line 17 from exceeding a maximum value.

The pump 14 is driven by an internal combustion engine (not shown) which utilizes the apparatus 11 for fuel injection and is constructed so that the output fuel pressure in the line 17 increases in a preferably linear manner as the engine speed (revolutions per minute) increases.

The apparatus 11 is illustrated as being incorporated in a distribution type fuel injection system although it clearly may be adapted to control the injection advance angle in other types of fuel injection systems. A piston or plunger 21 is rotatably driven by the engine, although the drive connection is not shown. A cam disc 22 is fixed to the lower end of the piston 21 and urged by a spring (not shown) into engagement with a roller carrier 23. The carrier 23 is in the form of a disc and carries balls or rollers 24 in recesses (not designated) in its upper surface which rollingly engage with the cam 22. The lower surface of the cam 22 is formed with projections (not designated) in a number equal to the number of cylinders of the engine. Rotation of the piston 21 causes the cam 22 to ride up and down on the rollers 24 and thereby causes the piston 21 to reciprocate in a bore 26 of the housing 12.

During a downward or return stroke of the piston 21, fuel from the chamber 16 flows into the upper closed end of the bore 26 through a passageway 27 formed through the housing 12 and an annular groove 28 formed in the upper end of the piston 21.

As the piston 21 moves upward during a fuel injection stroke, the lower end of the groove 28 moves above the opening of the passageway 27 so that the passageway 27 no longer communicates with the upper portion of the bore 26. This causes fuel to be compressed and displaced through an axial passageway 29 in the piston 21 and a distribution groove 31 which communicates with the passageway 29 into an outlet passageway 32 formed through the housing 12. When the pressure in the passageway 32 reaches a sufficiently high value, the fuel is fed through a check valve 33 and line 34 to a fuel injection nozzle (not shown) and thereby into an engine cylinder.

The piston 21 is further formed with a radial passageway 36 which leads from the axial passageway 29. A sleeve 37 is slidably disposed around the piston 21. The sleeve 37 is positioned so as to cover the passageway 36 and allow the piston 21 to compress fuel in the bore 26 and displace the same through the passageway 32 for fuel injection. However, after the piston 21 has moved upwardly to a certain extent, the opening of the passageway 36 moves above the upper end of the sleeve 37 and thereby communicates the upper portion of the bore 26 with the chamber 16 through the passageways 29 and 36. At this point, the pressure in the bore 26 drops almost instantaneously to the level of the pressure in the chamber 16 and the check valve 33 closes. This terminates fuel injection.

The sleeve 37 is positioned by a governor (not shown) through a lever 38 which is pivotal about a pin 39. Clockwise rotation of the lever causes the sleeve 37 to move downwardly and decrease the amount of fuel injection and vice-versa. It will be understood that the vertical position of the sleeve 37 determines the point in the fuel injection cycle at which fuel injection terminates, and therefore the amount of fuel injection. The higher the sleeve 37, the larger the amount of fuel injection.

Although only one passageway 32 is shown, there are actually provided a number of similar passageways equal to the number of cylinders in the engine. The openings of the passageways 32 are equally circumferentially spaced from each other. Thus, rotation of the piston 21 causes fuel to be distributed to the engine cylinders through the passageways 32. Reciprocation of the piston 21 serves the function of compressively displacing fuel to the cylinders for injection.

The fuel injection advance angle is controlled by means of an arm 41 fixed at one end to the roller carrier 23. The carrier 23 is rotatable perpendicular to the plane of FIG. 1 and parallel to the plane of FIG. 2. The other end of the arm 41 is fixed to a ball 42 which is rotatably received in a socket 43 of a first or main piston 44. The piston 44 is slidable in a first bore 46 in the housing 12. Leftward movement of the piston 44 causes the roller carrier 23 to rotate clockwise in FIG. 2 and increase the advance angle of fuel injection. In other words, the larger the advance angle, the earlier before top dead center of the engine pistons (not shown) at which fuel injection begins.

The piston 44 is urged rightwardly by a compression spring 47. The left end portion of the bore 46 communicates through a line 48 with the reservoir or tank 13 which is non-pressurized, thereby allowing return of leaked fuel.

A second piston 49 is slidably disposed in a second bore 51 in the housing 12 and is urged leftwardly by a compression spring 52 toward abutment with an end wall 53 of the bore 51. The diameter of the bore 51 is larger than the diameter of the bore 46, the bores 51 and 46 colinearly communicating with each other through the end wall 53. An extension **49*a* of the piston 49 extends into the first bore 46 through the wall 53. The annular periphery of the left end of the piston 49 is raised as indicated at 49*b* so that when the piston 49 abuts against the wall 53 a space 54 is defined between the left end of the piston 49 inwardly of the raised portion 49*b* and the wall 53. The right end of the piston 44 is similarly raised as indicated at 44*a* so that when the piston 44 abuts against the extension 49*a* a space 56 is defined therebetween inwardly of the raised portion 44*a*. A passageway 57 communicates the chamber 16 with the space 56 so that pressurized fuel acts on the right end of the piston 44 against the force of the spring 47 and on the left end of the piston 49 against the force of the spring 52. The portion of the bore 51 rightward of the piston 49 is connected to the reservoir 13**.

The spring 52 is stronger than the spring 47. However, the area of the piston 49 (inwardly of the portion 49*b*) exposed to the pressure in the space 56 is larger than the area of the piston 44 (inwardly of the portion 44*a*) exposed to the pressure in the space 56.

The operation of the apparatus 11 described thus far is as follows. When the engine is first started, the output pressure of the pump 14 and thereby the pressure in the chamber 16, passageway 56 and space 56 is very low. Since the spring 52 is stronger than the spring 47, the spring 52 pushes the piston 49 leftwardly into abutting engagement with the wall 53. The spring 47 pushes the piston 44 rightwardly into abutting engagement with the piston 49.

This condition is maintained until the pressure in the space 56 is sufficient to overcome the preload of the spring 52. This occurs at an engine speed N1. The increased pressure in the space 56 causes the piston 49 to move rightwardly into abutment with an end wall 58 which occurs at an engine speed N2. The spring 47 moves the piston 44 rightwardly along with the piston 49 in the rightward direction from a position $\theta 2$ to a position $\theta 1$. This has the effect of retarding the advance angle from a relatively advanced value corresponding to $\theta 2$ to a relatively retarded value corresponding to $\theta 1$. This condition remains until the engine speed further rises to a value N3 at which the fuel pressure in the chamber 56 is sufficient to overcome the preload of the spring 47. Thereafter, the piston 49 remains in its rightmost position while the piston 44 is progressively moved leftwardly to advance the angle as the engine speed increases. Although the spring 52 is stronger than the spring 47, the piston 49 is moved by fuel pressure in the space 56 before the piston 44 since the pressure receiving area of the piston 49 is sufficiently larger than that of the piston 44.

The operation described thus far corresponds to the prior art and also to the present invention after the engine has been started. However, as discussed above, it is desirable to prevent the advance angle from being retarded until the engine has been successfully started and warmed up. This effect is accomplished as follows.

The spring 52 is disposed in a chamber 59 defined by the right end of the piston 49 and the wall 58. The chamber 59 communicates with the reservoir 13 through a passageway or line 61. The chamber 59 is disposed at or below the level of the reservoir 13 so that fuel at substantially zero pressure is constantly urged by gravity to flow into and fill the chamber 59 through the line 61.

An electrically controlled valve 62 is disposed in the line 61. A check valve 63 is connected across the valve 62 to allow flow of fuel therethrough only from the reservoir 13 into the chamber 59.

The valve 62 is normally closed and constructed to be opened by an electrical signal from a control unit 64. The control unit 64 is responsive to a sensor 66 which may be a timer, engine speed sensor, engine coolant temperature sensor or the like.

When the engine is shut down, the valve 62 is closed and the piston 49 moved into engagement with the wall 53. Fuel from the reservoir 13 fills the chamber 59 and line 61 through the check valve 63. Since the valve 62 is closed, fuel in the chamber 59 and line 61 between the chamber 59 and valve 62 prevents rightward movement of the piston 49 since the fuel is liquid and incompressible. In other words, the piston 49 is rendered immovable by a hydraulic or fluid lock.

The control unit 64 is constructed to open the valve 62 after an engine operating parameter sensed by the sensor 66 reaches a predetermined value, for example, when the engine speed exceeds a value N4. The value of the engine operating parameter is designed to indicate that the engine has been successfully started and is operating in a stable manner. Thus, the injection angle will remain advanced at $\theta 2$ until the valve 62 opens at the engine speed N4. Further increase in engine speed will cause the piston 44 to move further leftwardly from $\theta 2$ to increase the advance angle. A decrease in engine speed from N4 will cause the piston 49 to move advance angle. A decrease in engine speed from N4 will cause the piston 49 to move rightwardly into abutment with the wall 58 and will cause the piston 44 to move rightwardly to an extent depending on the pressure in the space 56.

A reduction in engine speed to N3 will cause the piston 44 to abut against the piston 49. The pistons 44 and 49 will remain in abutment in their rightmost position $\theta 1$, thus retarding the advance angle for idling, until the engine speed drops to N2. Thereafter, the force of the spring 52 will overcome the pressure in the space 56 until the speed N1 is reached at which the piston 49 abuts against the wall 53. Any further reduction in engine speed below N1 will not produce any change since the pistons 44 and 49 will remain at the position $\theta 2$.

The sensor 66 may be constituted by a timer to open the valve 62 after a predetermined length of time has elapsed since the engine was initially energized. Alternatively, the sensor 66 may measure some other parameter such as engine coolant temperature, and open the valve 62 after the temperature reaches a predetermined value at which the engine is operating stably.

Figure 4:
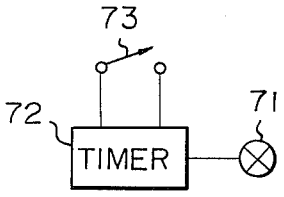
FIG. 4 is a schematic view of an alternative embodiment of the present invention.

Another embodiment of the invention is shown in FIG. 4. Here, the normally closed valve 62 is replaced by a normally open valve 71. The check valve 63 is not required in this embodiment. The valve 71 is controlled by a timer 72 which is actuated by a key switch 73. When the key switch 73 is closed to turn on the engine, the timer 72 closes the valve 71 for a predetermined length of time sufficient to stably start the engine. Thereafter, the timer 72 opens the valve 71. The result is the same as in FIG. 3 since a hydraulic lock is applied to the piston 49 until the engine is started and operating normally.

In both embodiments, the piston 49 is returned to the leftward position for advancing the injection angle when the engine is shut down in an automatic manner since the pressure in the space 56 drops to zero. In the embodiment of FIG. 2 fuel fills the chamber 59 through the check valve 63. In the embodiment of FIG. 4 the fuel fills the chamber 59 through the valve 71 since the valve 71 is opened when the switch 73 is opened.

In summary, it will be seen that the present invention provides an improved fuel injection advance control apparatus which ensures that the injection angle will be advanced until the engine is stably started, yet will enable the angle to be automatically retarded for constant speed idling operation. Various modifications will become possible for those skilled in the art after receiving the teachings of the present disclosure without departing from the scope thereof. For example, a Schmitt trigger or other hysterisis means may be disposed between the control unit 64 and valve 62 so that the valve 62 will open at an upper trip value and close at a lower trip value.

What is claimed is:

1. A fuel injection control apparatus for an engine including a housing having a first bore, a second bore having an end wall, the first bore colinearly communicating with the second bore through said end wall, a diameter of the second bore being larger than a diameter of the first bore, a first piston slidable in the first bore and being connected so that a fuel injection advance angle of the apparatus corresponds to a position of the first piston, a second piston slidable in the second bore, a first spring urging the first piston toward abutment with the second piston, a second spring urging the second piston toward abutment with said end wall, a non-pressurized liquid fuel reservoir, engine driven pump means for pumping fuel from the reservoir at a pressure which increases with engine speed and a first passageway connecting the pump means with a space between adjacent ends of the first and second pistons respectively, characterized by comprising:

a second passageway connecting the reservoir with the second bore such that fuel from the reservoir is constantly urged to flow through the second passageway into the second bore and contact an end of the second piston opposite to said adjacent end;

a valve disposed in the second passageway;

control means for initially closing the valve to apply a liquid lock to the second piston and opening the valve to remove the liquid lock from the second piston after an engine operating parameter reaches a predetermined value; and a check valve connected across the valve, the check valve allowing flow of fuel therethrough only from the reservoir to the second bore.

2. An apparatus as in claim 1, in which the control means is constructed to open the valve when a predetermined length of time has elapsed after starting the engine.

3. An apparatus as in claim 1, in which the control means is constructed to open the valve when an engine speed reaches a predetermined value.

4. An apparatus as in claim 1, in which the control means is constructed to open the valve when an engine coolant reaches a predetermined temperature.

5. An apparatus as in claim 1, in which the valve is electrically controlled by the control means.

6. An apparatus as in claim 1, in which the second spring is stronger than the first spring.

7. An apparatus as in claim 2, in which the control means comprises a timer.

* * * * *